US008292589B2

(12) United States Patent
Koga

(10) Patent No.: US 8,292,589 B2
(45) Date of Patent: Oct. 23, 2012

(54) CASTING ALUMINUM ALLOY, CAST COMPRESSOR IMPELLER COMPRISING THE ALLOY, AND PROCESS FOR PRODUCING THE SAME

(75) Inventor: Masaaki Koga, Yasugi (JP)

(73) Assignees: Hitachi Metals Precision, Ltd., Tokyo (JP); Hitachi Metals, Ltd., Tokyo (JP)

( * ) Notice: Subject to any disclaimer, the term of this patent is extended or adjusted under 35 U.S.C. 154(b) by 856 days.

(21) Appl. No.: 12/306,389

(22) PCT Filed: Jun. 26, 2007

(86) PCT No.: PCT/JP2007/062779

§ 371 (c)(1),
(2), (4) Date: Dec. 23, 2008

(87) PCT Pub. No.: WO2008/001758

PCT Pub. Date: Jan. 3, 2008

(65) Prior Publication Data

US 2009/0196762 A1 Aug. 6, 2009

(30) Foreign Application Priority Data

Jun. 29, 2006 (JP) ..... 2006-179092

(51) Int. Cl.
*C22C 21/12* (2006.01)

(52) U.S. Cl. ..... 416/203; 416/223 R; 416/241 R; 420/535

(58) Field of Classification Search ..... 416/203, 416/223 R, 241 R; 420/535
See application file for complete search history.

(56) References Cited

U.S. PATENT DOCUMENTS

2002/0185244 A1* 12/2002 Decker et al. ..... 164/35
2005/0167009 A1* 8/2005 Shoji et al. ..... 148/417

FOREIGN PATENT DOCUMENTS

| | | | |
|---|---|---|---|
| AT | 137305 | B | 4/1934 |
| EP | 1 557 567 | A2 | 7/2005 |
| GB | 379 004 | A | 8/1932 |
| GB | 1 396 216 | A | 6/1975 |
| JP | 1-247550 | A | 10/1989 |
| JP | 1-272743 | A | 10/1989 |
| JP | 03-039453 | A | 2/1991 |
| JP | 3-039453 | A | 2/1991 |
| JP | 06-145866 | A | 5/1994 |

(Continued)

OTHER PUBLICATIONS

European Search Report dated Dec. 12, 2010.

(Continued)

*Primary Examiner* — Angel Roman
(74) *Attorney, Agent, or Firm* — Sughrue Mion, PLLC

(57) ABSTRACT

A casting aluminum alloy which contains, in terms of mass %, 3.2-5.0% Cu, 0.8-3.0% Ni, 1.0-3.0% Mg, 0.05-0.20% Ti, and up to 1.0% Si, the remainder being aluminum and incidental impurities. This casting aluminum alloy is used to produce a cast compressor impeller comprising a hub part, a hub-disk part extending from the hub part in the radial directions and having a hub surface and a disk surface, and blade parts disposed on the hub surface. Compared to conventional aluminum alloys, the casting aluminum alloy has a moderate elongation and a high strength at ordinary temperature and has high strength even at high temperatures.

7 Claims, 2 Drawing Sheets

FOREIGN PATENT DOCUMENTS

| | | | |
|---|---|---|---|
| JP | 6-322467 | A | 11/1994 |
| JP | 7-179977 | A | 7/1995 |
| JP | 7-242976 | A | 9/1995 |
| JP | 8-144002 | A | 6/1996 |
| JP | 2004315952 | | 11/2004 |
| JP | 2005-206927 | A | 8/2005 |
| JP | 2008088460 | | 4/2008 |
| WO | 2006/090701 | A1 | 8/2006 |

OTHER PUBLICATIONS

Japanese Office Action issued in Application No. 2008-522584 dated Oct. 3, 2012.

The Japan Institute of Light Metals, "Aluminum Handbook", 5th ed., Jul. 25, 1994, p. 16.

* cited by examiner

FIG. 2

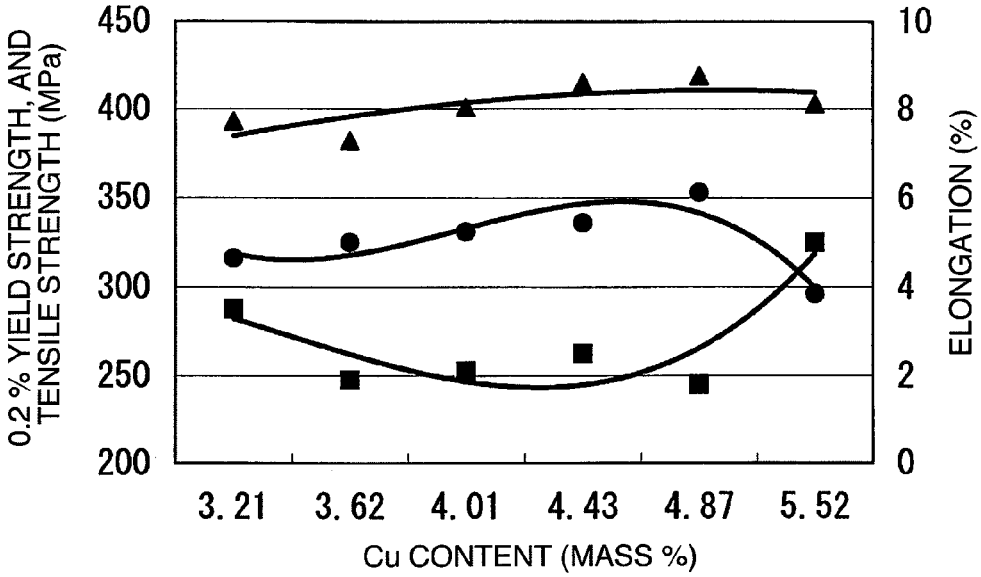

● : 0.2 % YIELD STRENGTH
(SOLID LINE BEING A THIRD ORDER POLYNOMIAL APPROXIMATING CURVE)
■ : ELONGATION
(SOLID LINE BEING A THIRD ORDER POLYNOMIAL APPROXIMATING CURVE)
▲ : TENSILE STRENGTH
(SOLID LINE BEING A QUADRATIC POLYNOMIAL APPROXIMATING CURVE)

FIG. 3

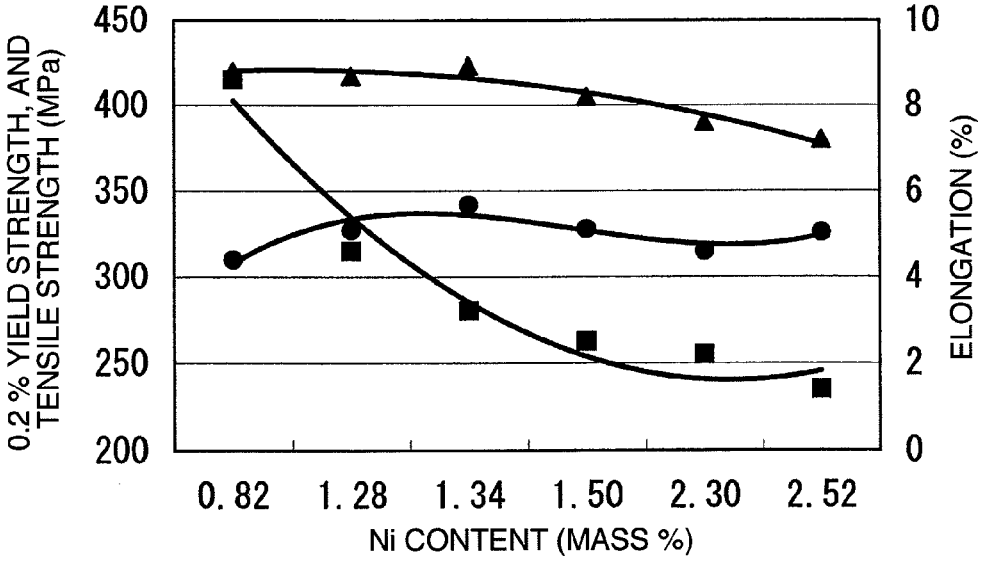

● : 0.2 % YIELD STRENGTH
(SOLID LINE BEING A THIRD ORDER POLYNOMIAL APPROXIMATING CURVE)
■ : ELONGATION
(SOLID LINE BEING A QUADRATIC POLYNOMIAL APPROXIMATING CURVE)
▲ : TENSILE STRENGTH
(SOLID LINE BEING A QUADRATIC POLYNOMIAL APPROXIMATING CURVE)

CASTING ALUMINUM ALLOY, CAST COMPRESSOR IMPELLER COMPRISING THE ALLOY, AND PROCESS FOR PRODUCING THE SAME

CROSS REFERENCE TO RELATED APPLICATIONS

This application is a National Stage of International Application No. PCT/JP2007/062779 filed Jun. 26, 2007, claiming priority based on Japanese Patent Application No. 2006-179092 filed Jun. 29, 2006, the contents of all of which are incorporated herein by reference in their entirety.

TECHNICAL FIELD

The present invention relates to a casting aluminum alloy having a high strength befitted to compressor impellers used in, for example, superchargers, a cast compressor impeller made of the casting aluminum alloy, and a method of producing the same.

BACKGROUND ART

With superchargers incorporated in internal combustion engines of automobiles, ships or vessels, for example, exhaust gases from an internal combustion engine are made use of rotating a turbine impeller on an exhaust side and a compressor impeller disposed on an intake side to be coaxial with the turbine impeller to take in an outside air to compress the same. Such superchargers function to supply an air as compressed to the internal combustion engine to achieve an improvement in output thereof.

Since the turbine impeller used in the supercharger described above is exposed to high-temperature exhaust gas discharged from the internal combustion engine, nickel alloys, alloys consisting of titanium and aluminum, etc., which are excellent in heat resisting strength, are ordinarily used therefor. On the other hand, since compressor impellers are made use of in those portions, in which an outside air is taken, and not exposed to high temperature, aluminum alloys, etc. are ordinarily used therefor.

Conventionally, aluminum alloys for compressor impellers include 354.0 (Al-9% Si-1.8% Cu-0.5% Mg alloy) and 355.0 (Al-5% Si-1.3% Cu-0.5% Mg alloy) specified in American Society for Testing and Materials Standard (ASTM), JIS-AC4C (Al-7% Si-0.3% Mg alloy), etc.

Also, for example, Prior Art Publication 1 discloses a high-pressure casting aluminum alloy containing, by mass %, 4 to 12% Si, 0.2 to 0.6% Mg, up to 0.3% Ti, and 0.001 to 0.01% B, another aluminum alloy containing 2 to 5% Cu further added to the composition of the above casting aluminum alloy, and a still another aluminum alloy containing 0.002 to 0.02% Sr further added to the compositions of the above aluminum alloys, respectively.

In recent years, various examinations have been made on high-speed rotation of turbine impellers and compressor impellers with a view to a further improving internal combustion engines in combustion efficiency. It is predicted in these examinations that with compressor impellers, an centrifugal force acting on an impeller upon rotation at high speed increases and an exposure temperature of around 150° C. in an actual situation increases to 180 to 200° C. due to high-speed rotation. Therefore, it is assumed that a further high strength in addition to a proper toughness at ordinary temperature is needed for compressor impellers, or it is assumed that a high strength is further needed at a temperature of 180 to 200° C.

Under the above background, it has been examined to apply, to materials of compressor impellers, magnesium alloys being higher in strength than conventional aluminum alloys, expensive titanium alloys being higher in strength than aluminum alloys and enabled to be made more light in weight than magnesium alloys, etc. Also, on the other hand, light-weight and inexpensive aluminum alloys are practically useful and an engineering development for making conventional aluminum alloys further high in strength is considerably expected. While aluminum alloys of high strength include, for example, an aluminum forged alloy A2618 (prescribed in ASTM), a characteristic comparable to that thereof is demanded of compressor impellers, for which a casting aluminum alloy is used.

Prior Art Publication 1: JP-A-6-145866

DISCLOSURE OF THE INVENTION

Problems to be Solved by the Invention

Conventional aluminum alloys, for example, ASTM 354.0 described above, and an alloy disclosed in Prior Art Publication 1 contain a large quantity of Si in order to ensure a strength and castability. For example, Prior Art Publication 1 discloses embodiments of two cases where Si is 7.0% and where Si is 9.0% and describes in claims that Si has a content of 4 to 12%. These conventional aluminum alloys having a favorable castability is useful in the case where a complex configuration, in which thin-walled portions and thick-walled portions like an impeller part and a hub part of a compressor impeller are co-existent, is to be cast and formed.

In the case where a large quantity of Si is added, however, it is assumed that a large quantity of Si crystallized substance is created to mar elongation to lead to insufficiency in strength at ordinary temperature. Further, since a decrease in strength such as 0.2% yield strength and tensile strength is brought about at high temperature such as 150° C. and 200° C., an increase in strength at high temperature is also desired.

An object of the invention is to provide a casting aluminum alloy having a proper elongation and a high strength at ordinary temperature as compared with conventional aluminum alloys and desirably having a high strength also at high temperature.

Also, another object of the invention is to provide a cast compressor impeller using the casting aluminum alloy.

Means for Solving the Problems

In view of the problems, the present inventors have examined, in conventional Al—Si—Cu—Mg alloys, restricting Si content as far as possible and providing for a high strength at ordinary temperature while providing for a proper elongation, desirably, providing for a high strength at high temperature such as 150° C. and 200° C. Then, it has been found that the problem can be solved by adding Ni as a substitute for Si and optimizing Ni content, Cu content, and Mg content, and then the invention has bee reached.

Thus, according to the invention, there is provided a casting aluminum alloy comprising, by mass %, 3.2 to 5.0% Cu, 0.8 to 3.0% Ni, 1.0 to 3.0% Mg, 0.05 to 0.20% Ti, and not more than 1.0% Si, and the balance being Al and unavoidable impurities.

The casting aluminum alloy of the invention desirably comprises, by mass %, 3.5 to 5.0% Cu.

More desirably, the casting aluminum alloy of the invention comprises, by mass %, 4.0 to 5.0% Cu and 1.0 to 2.0% Ni.

Also, desirably, the casting aluminum alloy of the invention contains Cu and Ni so as to fulfill the equation Ni≦1.08Cu-2.0% by mass %.

Also, more desirably, the casting aluminum alloy of the invention contains Cu and Ni so as to fulfill the equation Ni≦1.08Cu-2.43% by mass %.

The casting aluminum alloy of the invention can comprise, by mass %, 1.2 to 2.5% Mg and 0.3 to 1.0% Si.

The casting aluminum alloy of the invention can comprise, by mass %, 0.001 to 0.06% B.

The casting aluminum alloy of the invention may have a tensile strength of not less than 380 MPa and an elongation of at least 5.0% at ordinary temperature (i.e. 25° C.), a tensile strength of not less than 330 MPa at a temperature of 150° C., and a tensile strength of not less than 300 MPa at a temperature of 200° C. In addition, the numerical value of the elongation is of fracture elongation (refer to JIS-Z2241).

In the invention, it is preferable to apply the casting aluminum alloy of the invention to a cast compressor impeller used in automobiles, etc., which is an impeller-shaped body comprising a hub shaft part, a hub disk part extending radially from the hub shaft part and having a hub surface and a disk surface, and a plurality of blade parts provided on the hub surface.

Also, it is possible to apply the casting aluminum alloy of the invention to a cast compressor impeller, in which the plurality of blade parts comprise full blades and splitter blades, the both blades being arranged alternately.

The cast compressor impeller can be improved in mechanical properties by preparing the cast impeller formed from the casting aluminum alloy of the invention and comprising a hub shaft part, a hub disk part extending radially from the hub shaft part and having a hub surface and a disk surface, and a plurality of blade parts provided on the hub surface; subjecting the cast impeller to solution treatment at a temperature of 480 to 550° C. for 6 to 16 hours, and subjecting the cast impeller, already subjected to the solution treatment, to aging treatment at a temperature of 150 to 200° C. for 3 to 16 hours. Thus, it is possible to obtain an excellent cast compressor impeller.

Also, desirably the solution treatment is conducted at a temperature of 530 to 550° C. for 8 to 12 hours, and the aging treatment is conducted at a temperature of 170 to 190° C. for 6 to 10 hours.

Effect of the Invention

The casting aluminum alloy of the invention can have a proper elongation and a high strength at ordinary temperature (i.e. 2° C.) as compared with conventional aluminum alloys for cast compressor impellers, etc. Furthermore, the casting aluminum alloy is expectable to have a high strength at high temperature such as 150° C. or 200° C. The invention is of a industrially very advantageous technology since the cast compressor impeller being usable in higher speed rotation than conventional and in an environment of high temperature can be obtained by using the casting aluminum alloy to form a cast compressor impeller for superchargers mounted on, for example, automobiles, etc.

BEST MODE FOR CARRYING OUT THE INVENTION

A key feature of the casting aluminum alloy of the invention is to add Ni as an alternative to Si and to optimize Ni, Cu and Mg contents, in conventional Al—Si—Cu—Mg alloys.

Subsequently, a detailed explanation will be given to alloying elements added to Al in the casting aluminum alloy of the invention and reasons why the respective alloying elements are restricted in content. Also, contents of the respective alloying elements are represented by mass % unless otherwise specified.

In the invention, in order to compensate for strength reduction due to not a lot of additive Si, Cu and Mg amounts have been first optimized. In the case where a lot of Si is not contained, Cu and Mg are important elements having advantageous effects which are solid-solution strengthening and precipitation strengthening, wherein the solid-solution strengthening can be realized according as the elements are dissolved into an Al matrix to improve strength, and wherein the precipitation strengthening can be realized by subjecting a casting to heat treatment (T6 treatment:JIS-H0001) to improve strength.

Cu: 3.2 to 5.0%

In the invention, the Cu content is set to be 3.2 to 5.0% whereby a sufficient strength is obtained without inhibiting an improvement in elongation. When the Cu content is 3.2% or less, no sufficient strength is obtained in some cases since a dissolved Cu amount in an Al matrix is inadequate. Also, when the Cu content exceeds 5.0%, fracture elongation (referred below to as elongation) is decreased in some cases since intermetallic compounds such as $CuAl_2$ (θ phase) crystallize or precipitate at grain boundaries in abundance. The Cu content is desirably 3.5 to 5.0%, more desirably 4.0 to 5.0%.

Mg: 1.0 to 3.0%

In the invention, Mg content is set to be 1.0 to 3.0% whereby Mg is dissolved into an Al matrix. Alternatively, in the case where Si is contained, Mg and Si create an intermetallic compound ($Mg_2Si$) to cause solid solution. Thereby, there are produced a function and an effect of an improvement in elongation. Accordingly, a casting alloy having a proper elongation can be expected by making Mg content preferable. When Mg content is less than 1.0%, a dissolved Mg in an Al matrix is too small and so solid-solution strengthening cannot be expected. Also, when Mg content exceeds 3.0%, elongation is decreased, so that a proper elongation is not only obtained but also castability is markedly impeded in some cases. Mg content is desirably set to be 1.2 to 2.5%.

Ni: 0.8 to 3.0%

In the invention, Ni content is set to be 0.8 to 3.0% taking into consideration Cu and Mg amounts described above. When an appropriate quantity of Ni is contained, a Ni intermetallic compound is created whereby a strength, in particular, at high temperature can be improved. When Ni content is less than 0.8%, an improvement in strength cannot be expected since a Ni intermetallic compound is short in quantity of crystallization and quantity of precipitation. Also, when Ni content exceeds 3.0%, a Ni system crystallized substance or a precipitate is created in abundance to lead to a decrease in elongation. Ni content is desirably set to be 1.0 to 2.0%.

Also, Cu content and Ni content desirably fulfill the equation Ni≦1.08Cu-2.0%, more desirably, the equation Ni≦1.08Cu-2.43%. A casting aluminum alloy containing Cu and Ni creates crystallized substances such as $Al_5NiCu$ (Y phase) and $CuAl_2$ (θ phase) at the time of solidification and creates a crystallized substance such as $Mg_2Si$ in case of containing Si. $Al_5NiCu$ (Y phase) being an intermetallic compound containing Ni is preferentially crystallized. While a Y phase heightens a strength at high temperature, an excessive crystallization leads to a decrease in elongation. Also, Cu being not taken into the Y phase mainly creates $CuAl_2$ (θ phase) to contribute to precipitation strengthening obtained through solution treatment and aging treatment. Therefore, creation of the Y phase and the θ phase is desirably adjusted by causing Cu content and Ni content to fulfill the equation and a further improvement in strength at ordinary temperature can be expected by providing a preferable balance between strength and elongation. Alternatively, an improvement in strength at high temperature such as 150 to 200° C. can also be expected.

Ti: 0.05 to 0.20%

In the invention, when Ti content is set to be 0.05 to 0.20%, crystal nucleus of $TiAl_3$ or the like crystallize at grain boundaries in a process, in which an Al matrix is created. Thereby, growth of crystal grains of the Al matrix is inhibited and crystal grains of the Al matrix are made minute. By making crystal grains of the Al matrix itself minute, a further improvement in strength can be expected for a casting aluminum alloy. When Ti content exceeds 0.2%, however, $TiAl_3$ or the like crystallizes excessively at grain boundaries of the Al matrix to lead to a decrease in elongation occasionally.

Si: 1.0% or less

In the invention, Si content is set to be 1.0% or less in view of Mg amount. Si combines with Mg to create $Mg_2Si$. The $Mg_2Si$ is dissolved into an Al matrix by solution treatment and then precipitated uniformly and minutely by aging treatment whereby a further improvement in strength at ordinary temperature can be expected. In the invention, however, when Si content exceeds 1.0%, Si, which cannot be dissolved into the Al matrix, remains as precipitated substance at grain boundaries whereby elongation is occasionally degraded. Also, since Si preferentially combines with Mg, Mg dissolved into the Al matrix is decreased in quantity to lead to a decrease in elongation and strength occasionally. When this happens, it becomes critical in use for, for example, cast compressor impellers, for which a proper elongation and elongation are desired. Si content is desirably set to be 0.3 to 1.0%.

In the casting aluminum alloy of the invention, Cu, Mg, and Ti described above are elements that are positively added to provide for effective functions and effects. Also, Si described above is an element that is positively added in view of Mg amount to provide for effective functions and effects. Also, as described later, functions and effects of Ti can also be promoted by adding B taking into consideration Ti amount. The remainder except these elements includes Al that makes a matrix, and unavoidable impurities.

In the invention, while B is an element that should be not necessarily contained, a marked advantage is given in terms of cost by using TiB as a raw material instead of using a pure Ti as a raw material of Ti. In this case, adjustment, in which B being about 20% of Ti content is contained, is desirable. Thereby, B acts to further heighten functions and effects of Ti, such as creation of $TiB_2$, etc. and promotion of making crystal grains of an Al matrix minute. For example, in the case where Ti content is set to be 0.05 to 0.20%, B content is desirably adjusted to be 0.001 to 0.06%. In this case, even when B content in excess of 0.6% is contained, an improvement in effects cannot be expected and $TiB_2$ or the like is crystallized in abundance to lead to a decrease in elongation occasionally.

In some cases, elements such as Zn, Fe, Mn, Pb, Sn, Cr, C, N, and O are mixed as unavoidable impurities in the invention. Fe and Mn out of unavoidable impurities are known to have functions and effects of an improvement in sticking tendency at the time of metal mold casting of an Al—Si alloy. In the casting aluminum alloy of the invention, for example, around 0.2% Fe as impurities is readily mixed in the producing process of melting. However, not more than 1.5% Fe content does not impede the functions and effects of the invention.

It is important that a casting aluminum alloy of the invention have the composition of containing, by mass %, 3.2 to 5.0% Cu, 0.8 to 3.0% Ni, 1.0 to 3.0% Mg, 0.05 to 0.20% Ti, not more than 1.0% Si, and the remainder that contains Al and unavoidable impurities, as described above. After solution treatment, aging treatment is adjusted with respect to respective conditions of treatment and applied to the casting aluminum alloy having such alloy composition whereby it is possible to obtain a casting aluminum alloy having a desired characteristic, for example, a tensile strength of at least 380 MPa and an elongation of at least 5.0% at ordinary temperature (i.e. 25° C.), a tensile strength of at least 330 MPa at a temperature of 150° C., and a tensile strength of at least 300 MPa at a temperature of 200° C.

Also, the alloy composition contains, for example, 4.0 to 5.0% Cu, 1.0 to 2.0% Ni, 1.2 to 2.5% Mg, 0.05 to 0.20% Ti, not more than 1.0% Si, and after solution treatment, aging treatment is applied to the alloy composition under respective, preferable conditions of treatment whereby it is also possible to obtain a casting aluminum alloy having a desired characteristic, that is, a tensile strength of at least 430 MPa and an elongation of at least 5.0% at ordinary temperature (i.e. 25° C.), a tensile strength of at least 370 MPa at a temperature of 150° C., and a tensile strength of at least 330 MPa at a temperature of 200° C.

In this manner, the casting aluminum alloy of the invention having a more excellent strength than conventional while having a proper elongation at ordinary temperature and being enabled to have an excellent strength at high temperature such as 150 to 200° C. provides a cast compressor impeller capable of withstanding use in that range of high speed, in which a conventional Al—Si—Cu—Mg alloy cannot be applied due to insufficiency in strength, and at exposure temperature of 180 to 200° C., in use for, for example, cast compressor impellers. In addition, the cast compressor impeller of the invention will be described later.

Subsequently, an explanation will be given to solution treatment and aging treatment (T6 treatment:JIS-H0001) that give the excellent characteristic to the composition of the casting aluminum alloy of the invention.

Solution treatment is carried out for dissolving the respective intermetallic compounds in an Al matrix and it is possible to select conditions of treatment preferred for an alloy composition being an object. For example, a tensile strength and elongation are measured while changing conditions of a temperature and a time, which are retained, in several ways, thus enabling determining preferred temperature and time as conditions of treatment. Also, in order to ensure an elongation of at least 5.0% preferred for use in cast compressor impellers, etc., it is desirable to select conditions of treatment in view of a decrease in elongation, which is caused by aging treatment applied in a succeeding process.

Conditions of solution treatment can be adjusted by combining a temperature of 480 to 550° C. and a time of 6 to 16 hours. When a temperature as retained is lower than 480° C., a time as retained becomes long to impede productivity while a uniform solidification is brought about. When a temperature as retained exceeds 550° C., a dissolved amount is increased but a uniform solidification is hard to occur and there is occasionally caused a disadvantage called blister attributable to micro shrinkage present near to surfaces of a casting obtained from the casting alloy. Also, a time as retained can be adjusted in the range of 6 to 16 hours in conformance to the temperature as selected. In the invention, adjustment is desirable in the temperature range of 530 to 550° C. and in the duration of 8 to 12 hours, in which intermetallic compounds are liable to be stable in a dissolved amount in an Al matrix and in uniformity.

After solution treatment is applied under conditions of treatment as previously selected, aging treatment is carried out in order to precipitate the respective intermetallic compounds to ensure desired, mechanical properties such as 0.2% yield strength, elongation, tensile strength, etc. It suffices to select conditions of aging treatment preferred for an alloy composition being an object, and, time and temperature, which are preferred as conditions of treatment, can be determined by changing, for example, retention time and retained temperature in several ways to measure respective, mechanical properties. Also, it is desirable to select conditions of treatment, under which a characteristic, for example, a tensile strength of at least 330 MPa and an elongation of at least 5.0% at ordinary temperature (i.e. 25° C.), preferred for use in cast compressor impellers, etc.

Conditions of aging treatment can be adjusted by combining, for example, a temperature of 150 to 200° C. and a time of 3 to 16 hours. When a temperature as retained is lower than 150° C., precipitation of intermetallic compounds is hard to promote and a time as retained becomes long to impede productivity in some cases. When a temperature as retained exceeds 200° C., a precipitated quantity is increased but a uniform precipitation is hard to generate to lead to instability in characteristic in some cases. Also, a time as retained can be adjusted in the range of 3 to 16 hours according to the temperature as selected. In the invention, adjustment is desirable in the temperature range of 170 to 190° C. and in the duration of 6 to 10 hours, in which intermetallic compounds are liable to be stable in quantity of precipitation and in uniformity.

Also, it is possible in the invention to carry out HIP treatment (hot isostatic pressing treatment) before carrying out solution treatment and aging treatment described above. As conditions for HIP, a temperature being the same as that for solution treatment and as high as possible, that is, 480 to 550° C. is preferable because of softening and plastic deformation in a high-temperature environment. Also, pressure is desirably as high as possible and 90 MPa or higher is preferable and desirably retained for 1 to 5 hours. Thereby, an internal defect at the time of casting can be expected to become minute. In addition, since HIP treatment is the same in conditions of treatment as solution treatment, it is desirably carried out simultaneously with solution treatment in view of cost and productivity. Since rapid quenching such as water cooling, etc. is difficult in HIP treatment due to restrictions on an apparatus and intermetallic compounds once dissolved into an Al matrix are gradually quenched and precipitated by HIP treatment, however, the same effect as that of solution treatment is difficult to produce.

A cast compressor impeller of the invention will be described below.

The cast compressor impeller of the invention is obtained by using a casting aluminum alloy of the invention described above to cast and form an impeller configuration including a hub shaft part, a hub disk part extending radially from the hub shaft part and including a hub surface and a disk surface, and a plurality of blade parts arranged on the hub surface. Therefore, the cast compressor impeller has the same composition and mechanical property as those of the casting aluminum alloy of the invention described above. Also, the plurality of blade parts may comprise full blades and splitter blades, the both blades being arranged alternately. Thereby, a cast compressor impeller is provided to have a proper elongation and a higher strength than conventional one at ordinary temperature. Alternatively, a cast compressor impeller, for which an excellent strength can be expected even at high temperature of 150 to 200° C., is provided.

FIGS. 1A and 1B schematically show an example of the cast compressor impeller of the invention. The cast compressor impeller 1 (referred below to as impeller 1) comprises an impeller-shaped body including a hub shaft part 2, a hub disk part 3 extending radially from the hub shaft part 2 and having a hub surface 4 and a disk surface 5, and a plurality of blade parts arranged on the hub surface 4. Also, with the impeller part of the impeller 1, full blades 6 and short blades being splitter blades 7 are arranged alternately and, respectively, include complex, aerodynamically curved surfaces on front and back sides.

For example, the following means can be adopted for a method of producing the cast compressor impeller of the invention.

First, the casting aluminum alloy of the invention described above is used to obtain a cast impeller formed of an impeller-shaped body including a hub shaft part, a hub disk part extending radially from the hub shaft part and having a hub surface and a disk surface, and a plurality of blade parts arranged on the hub surface. Subsequently, it is possible to make use of means, in which the cast impeller thus obtained is subjected to solution treatment at a temperature of 480 to 550° C. for a time of 6 to 16 hours and then subjected to aging treatment at a temperature of 150 to 200° C. for a time of 3 to 16 hours to provide a cast compressor impeller. Also, it is possible to apply after-treatment such as deburring, polishing, etc. to the cast compressor impeller at need.

In addition, the solution treatment is desirably adjusted at a temperature of 530 to 550° C. for a time of 8 to 12 hours taking account of ensuring a quantity of an intermetallic compound dissolved into an Al matrix and evenly distributing the intermetallic compound in solution. Also, the aging treatment is desirably adjusted at a temperature of 170 to 190° C. for a time of 6 to 10 hours taking account of ensuring a precipitated quantity of an intermetallic compound and uniformly distributing the intermetallic compound in precipitation.

Application of a casting, by which a hub shaft part and an impeller part having a complex shape in a compressor impeller can be formed to a integrally casting as a single item, is advantageous to formation of a cast impeller in productivity, for example, plaster mold casting in which plaster is used to form, lost wax casting in which a casting die is fabricated from a sacrificial pattern having substantially the same shape as that of a product, or the like. Further, metal mold casting such as die casting or the like is also applicable, and in particular, application of die casting, in which a molten metal flow characteristic and a dense solidification structure can be expected, is advantageous for an improvement of a cast compressor impeller in productivity.

The cast compressor impeller of the invention may comprise an impeller, in which an impeller part has an undercut and mold opening of a casting die is difficult. When it is desired to obtain such cast compressor impeller, it is preferable to adopt the plaster mold casting in formation of a cast impeller, so that formation of a mold is made easy since a rubber pattern capable of large deformation can be used, and a mold is easily broken since plaster or the like can be used.

Also, even the lost wax casting and the metal mold casting can be applied provided that the following means is adopted. In such means, for example, an impeller part of a cast impeller being formed is shaped to afford mold opening, and after casting, machining such as cutting, push, bending, or the like is applied to form the impeller part into a final shape. Also, in such means, for example, a plurality of slide dies having a spatial shape between adjacent, respective blades of a compressor impeller are opposed to an axis of a hub shaft part and the slide dies are turned and moved radially of a central shaft to accomplish mold opening after a molten metal is poured into spaces thus formed to accomplish cast molding.

A molten metal made of the casting aluminum alloy of the invention can be manufactured by the following means. First, an aluminum alloy raw material containing predetermined quantities of the respective elements is obtained by melting a predetermined raw material to accomplish cast molding with the use of an ingot case such as metal die, etc. For melting, it is possible to use direct heating furnaces and indirect heating furnaces of gas type, electric type, or the like, and a melting crucible provided on a casting device and it is desirable to apply agitating and degassing treatments, etc. Also, it is desirable to handle a molten metal in the atmosphere or in an atmosphere of inert gas.

Also, various conditions such as casting temperature, casting pressure and casting speed of a molten metal, cooling pattern after casting, or the like at the time of casting in formation of the cast impeller can be appropriately selected according to a shape of a compressor impeller, a molten metal, a casting device, etc. For example, in plaster mold casting, it is possible to apply casting means, such as suction casting process, reduced pressure casting process, vacuum casting process, or low pressure casting process, etc. In particular, the suction casting process and the vacuum casting process are preferable since a favorable molten metal flow characteristic can be ensured in a thin-walled portion such as impeller part.

EMBODIMENT

Embodiment 1

The casting aluminum alloy of the invention will be further specifically described below with reference to embodiments.

First, alloys of respective compositions shown in TABLE 1, in which Cu content and Ni content are changed, were used to confirm a tendency of changes in respective mechanical properties. Specifically, a plurality of test pieces were fabricated from samples obtained by the use of a JIS 4 type boat form metal die and these test pieces were used to measure and evaluate 0.2% yield strength (JIS-Z2241), elongation (JIS-Z2241: fracture elongation), and tensile strength (JIS-Z2241) at ordinary temperature (i.e. 25° C.). All contents of respective elements are represented below by mass %. In addition, TABLE 1 shows Fe content being liable to be contained as unavoidable impurities.

TABLE 1

| | Composition (MASS %) | | | | | | | | | | HIP | | |
|---|---|---|---|---|---|---|---|---|---|---|---|---|---|
| No. | Cu | Ni | Mg | Ti | Si | B | 1.08Cu – 2.0 | 1.08Cu – 2.43 | Al | Example of impurities Fe | Temperature ° C. | Pressure MPa | Time h |
| C1 | 3.21 | 1.75 | 1.69 | 0.10 | 0.56 | 0.018 | 1.47 | 1.04 | Bal | 0.10 | 525 | 103 | 2 |
| C2 | 3.62 | 1.73 | 1.67 | 0.11 | 0.53 | 0.020 | 1.91 | 1.48 | Bal | 0.11 | 525 | 103 | 2 |
| C3 | 4.01 | 1.71 | 1.68 | 0.10 | 0.55 | 0.019 | 2.33 | 1.90 | Bal | 0.10 | 525 | 103 | 2 |
| C4 | 4.43 | 1.72 | 1.68 | 0.10 | 0.54 | 0.020 | 2.78 | 2.35 | Bal | 0.10 | 525 | 103 | 2 |
| C5 | 4.87 | 1.70 | 1.70 | 0.10 | 0.55 | 0.020 | 3.26 | 2.83 | Bal | 0.10 | 525 | 103 | 2 |
| C6 | 5.52 | 1.94 | 1.64 | 0.08 | 0.26 | 0.019 | 3.96 | 3.53 | Bal | 0.08 | 525 | 103 | 2 |
| N1 | 4.60 | 0.82 | 1.68 | 0.08 | 0.31 | 0.016 | 2.97 | 2.54 | Bal | 0.13 | 525 | 103 | 2 |
| N2 | 4.24 | 1.28 | 1.66 | 0.10 | 0.41 | 0.020 | 2.58 | 2.15 | Bal | 0.15 | 525 | 103 | 2 |
| N3 | 4.23 | 1.34 | 1.66 | 0.10 | 0.45 | 0.019 | 2.57 | 2.14 | Bal | 0.15 | 525 | 103 | 2 |
| N4 | 4.15 | 1.50 | 1.63 | 0.10 | 0.42 | 0.020 | 2.48 | 2.05 | Bal | 0.15 | 525 | 103 | 2 |
| N5 | 4.07 | 2.30 | 1.61 | 0.11 | 0.41 | 0.020 | 2.40 | 1.97 | Bal | 0.15 | 525 | 103 | 2 |
| N6 | 4.06 | 2.52 | 1.60 | 0.10 | 0.40 | 0.020 | 2.38 | 1.95 | Bal | 0.15 | 525 | 103 | 2 |

| | Solution treatment | | Aging treatment | | Ordinary temperature (25° C.) | | | |
|---|---|---|---|---|---|---|---|---|
| No. | Temperature ° C. | Time h | Temperature ° C. | Time h | Tensile strength MPa | 0.2% yield strength MPa | Elongation % | Remarks |
| C1 | 540 | 12 | 180 | 8 | 393 | 316 | 3.5 | Embodiment of invention |
| C2 | 540 | 12 | 180 | 8 | 382 | 325 | 1.9 | Embodiment of invention |
| C3 | 540 | 12 | 180 | 8 | 401 | 331 | 2.1 | Embodiment of invention |
| C4 | 540 | 12 | 180 | 8 | 415 | 336 | 2.5 | Embodiment of invention |
| C5 | 540 | 12 | 180 | 8 | 419 | 353 | 1.8 | Embodiment of invention |
| C6 | 540 | 12 | 180 | 8 | 403 | 296 | 5.0 | Comparative example |
| N1 | 540 | 12 | 180 | 8 | 420 | 310 | 8.6 | Embodiment of invention |
| N2 | 540 | 12 | 180 | 8 | 417 | 327 | 4.6 | Embodiment of invention |
| N3 | 540 | 12 | 180 | 8 | 423 | 342 | 3.2 | Embodiment of invention |
| N4 | 540 | 12 | 180 | 8 | 405 | 328 | 2.5 | Embodiment of invention |
| N5 | 540 | 12 | 180 | 8 | 390 | 315 | 2.2 | Embodiment of invention |
| N6 | 540 | 12 | 180 | 8 | 380 | 326 | 1.4 | Embodiment of invention |

Test pieces were formed and obtained by the following means. First, respective alloy molten metals were manufactured by the use of an electric melting furnace in the atmosphere, and sample molten metals were sampled at a temperature of 720° C. by a spoon to be cast and formed in the JIS 4 type boat form metal die (height of 40 mm, length of 180 mm, lower width of 20 mm, upper width of 30 mm) at a die temperature of 100° C. in the atmosphere, whereby a plurality of respective samples were obtained.

Subsequently, after HIP treatment was applied to the samples thus obtained, both solution treatment and aging treatment (T6 treatment) were applied thereto under the same conditions. Conditions thought to be preferable in view of compositions were selected as the respective treatment conditions. Specifically, HIP treatment was carried out under the conditions of a temperature of 525° C., a pressure of 103 MPa, and a time of 2 hours, solution treatment was water cooling after the samples were held at a temperature of 540° C. for 12 hours, and aging treatment was air cooling after the samples were held at a temperature of 180° C. for 8 hours.

Subsequently, machining was used to cut test pieces having a total length of 95.0 mm, an outside diameter of 12.7 mm and including a parallel portion having a length of 18.5 mm and a diameter of 6.35 mm from all the samples as obtained. Thereby, test pieces C1 to C6 and N1 to N6 in TABLE 1 were obtained.

The respective test pieces cast and obtained by the use of the JIS 4 type boat form metal die were formed to be more coarse in cast structure than test pieces formed by plaster mold casting, lost wax casting, die casting, or the like. Therefore, the test pieces were lower in mechanical properties, such as 0.2% yield strength, elongation, tensile strength, etc., than test pieces formed by the respective casting processes described above. However, comparative assessment of mechanical properties of the respective alloy compositions is possible and means of characteristic evaluation of alloys using such JIS 4 type boat form metal die is conventionally used.

Using the test pieces C1 to C6 and N1 to N6, 0.2% yield strength (MPa), elongation (%), and tensile strength (MPa) were measured at ordinary temperature (i.e. 25° C.). TABLE 1 shows results of measurement, FIG. 2 shows tendencies of changes in 0.2% yield strength, elongation, and tensile strength when Cu content was changed, and FIG. 3 shows tendencies of changes when Ni content was changed.

It could be confirmed that when Ni content or the like was substantially constant and Cu content was changed (C1 to C6), 0.2% yield strength tended to increase with an increase in Cu content and exhibited 300 MPa or more with 3.0 to 5.0% Cu content. However, it was confirmed that when Cu content was over 5.0%, 0.2% yield strength tended to lower considerably. It could be confirmed that elongation tended to stabilize when Cu content was around 2% and tended to increase when Cu content was small or large. It was recognized that tensile strength of 380 MPa or more was obtained and tended to increase with an increase in Cu content.

Therefore, it was found from those tendencies, in which test pieces cast by the use of the JIS 4 type boat form metal die were changed in mechanical properties relative to Cu content, that when 3.2 to 5.0% Cu was contained, 0.2% yield strength of 300 MPa or more and tensile strength of 380 MPa or more were obtained with a proper elongation. Also, it was found that when 3.5 to 5.0% Cu was contained, 0.2% yield strength of 300 MPa or more was obtained while elongation was stabilized. Further, it was found that when 4.0 to 5.0% Cu was contained, 0.2% yield strength of 330 MPa or more and tensile strength of 400 MPa or more were obtained with a proper elongation.

Also, it was recognized that when Cu content or the like was substantially constant and Ni content was changed (N1 to N6), 0.2% yield strength tended to exhibit a peak according to Ni content and to lower with Ni content being less than 0.8%. It was recognized that elongation tended to lower with an increase in Ni content. It was recognized that tensile strength tended to lower with an increase in Ni content.

Therefore, it was found from those tendencies, in which test pieces obtained by casting with the use of the JIS 4 type boat form metal die were changed in mechanical properties with Ni content, that when 0.8 to 3.0% Ni was contained, 0.2% yield strength of 300 MPa or more and tensile strength of 350 MPa or more were obtained with a proper elongation. Also, it was found that when 1.0 to 2.0% Ni was contained, 0.2% yield strength of 300 MPa or more and tensile strength of 400 MPa or more were obtained with a proper elongation.

From the above, it could be confirmed that in order to make mechanical properties preferable, it was important to preferably select Cu content and Ni content. It could be confirmed that favorable, mechanical properties were obtained when the casting aluminum alloy of the invention contained 3.2 to 5.0% Cu and 0.8 to 3.0% Ni. Also, it could be confirmed that in order to obtain stable and favorable mechanical properties, it was preferred that Cu content was desirably 3.5 to 5.0%, more desirably 4.0 to 5.0%. Also, it could be confirmed that it was preferred that Ni content was desirably 1.0 to 2.0%.

Embodiment 2

Subsequently, it was found from the test pieces obtained by casting with the use of the JIS 4 type boat form metal die that the casting aluminum alloy of the invention could have favorable mechanical properties. Hereupon, various mechanical properties were evaluated by using a molten metal made of the casting aluminum alloy of the invention to form a cast compressor impeller (impeller 1) shown in FIGS. 1A and 1B and cutting test pieces from the impeller 1 thus obtained. Likewise, evaluation was made with respect to 354.0 (referred below to as A354) prescribed in ASTM, which gives a conventional cast alloy constituting comparable examples of the invention.

Also, while being not a cast alloy, raw materials were purchased and mechanical properties thereof were evaluated with respect to 2618 (referred below to as A2618) prescribed in ASTM for aluminum forged alloys, which are generally used in a forged compressor impeller cut and manufactured from forged raw materials. TABLE 2 shows compositions of the alloys as evaluated.

TABLE 2

| | Composition (MASS %) | | | | | | | | | | | HIP | | |
|---|---|---|---|---|---|---|---|---|---|---|---|---|---|---|
| No. | Cu | Ni | Mg | Ti | Si | B | 1.08Cu − 2.0 | 1.08Cu − 2.43 | Sr | Al | Example of impurities Fe | Temperature ° C. | Pressure MPa | Time h |
| 1 | 2.62 | 1.10 | 1.55 | 0.14 | 0.65 | 0.023 | 0.83 | 0.40 | — | Bal | 0.10 | 525 | 103 | 2 |
| 2 | 3.21 | 1.61 | 1.60 | 0.14 | 0.61 | 0.023 | 1.47 | 1.04 | — | Bal | 0.10 | 525 | 103 | 2 |
| 3 | 3.54 | 2.81 | 1.38 | 0.10 | 0.06 | 0.017 | 1.82 | 1.39 | — | Bal | 0.13 | 525 | 103 | 2 |

TABLE 2-continued

| | | | | | | | | | | | | | | |
|---|---|---|---|---|---|---|---|---|---|---|---|---|---|---|
| 4 | 4.08 | 1.99 | 1.60 | 0.10 | 0.60 | 0.017 | 2.41 | 1.98 | — | Bal | 0.13 | 525 | 103 | 2 |
| 5 | 4.16 | 1.65 | 1.23 | 0.09 | 0.61 | 0.017 | 2.49 | 2.06 | — | Bal | 0.13 | 525 | 103 | 2 |
| A354 | 1.96 | — | 0.53 | 0.13 | 8.92 | 0.020 | — | — | 0.028 | Bal | 0.13 | 525 | 103 | 2 |
| A2618 | 2.51 | 1.11 | 1.59 | 0.05 | 0.20 | — | 0.71 | 0.28 | — | Bal | <0.10 | 525 | 103 | 2 |

| | Solution treatment | | Aging treatment | | |
|---|---|---|---|---|---|
| No. | Temperature ° C. | Time h | Temperature ° C. | Time h | Remarks |
| 1 | 540 | 12 | 180 | 8 | Embodiment of invention |
| 2 | 540 | 12 | 180 | 8 | Embodiment of invention |
| 3 | 540 | 12 | 180 | 8 | Embodiment of invention |
| 4 | 540 | 12 | 180 | 8 | Embodiment of invention |
| 5 | 540 | 12 | 180 | 8 | Embodiment of invention |
| A354 | 540 | 12 | 180 | 8 | Conventional example (cast) |
| A2618 | 540 | 12 | 180 | 8 | Conventional example (forged) |

Specifically, molten metals made of casting aluminum alloys having the compositions shown in TABLE 2 were used and the plaster mold casting process was applied to form an impeller shown in FIGS. 1A and 1B. First, a rubber pattern having a shape conformed to the impeller 1 was fabricated and the rubber pattern was used to fabricate a casting mold from plaster. Subsequently, a molten metal of a casting aluminum alloy having been melted and subjected to degassing treatment was cast in the casting mold by a updraw type vacuum casting process. After cooling, the casting mold was removed and a cast impeller formed integral with full blades 6, splitter blades 7, and a hub shaft part 2 could be obtained without a casting defect such as bad running of a molten metal, shrinkage cavities, pin holes, or the like. Also, in the case where a casting defect was present in the cast impeller, mechanical properties for a cast compressor impeller were impaired in some cases. Therefore, in order to make a casting defect, which was possibly present in the cast impeller, minute to an extent that mechanical properties were not impaired, the cast impeller thus obtained was subjected to HIP treatment (hot isostatic pressing treatment) at 525° C. at 103 MPa for 2 hours.

Subsequently, solution treatment and aging treatment were applied on the cast impeller thus obtained. In application of solution treatment and aging treatment, solution treatment was selected in view of productivity so as to enable shortening a time for retention as far as possible. Specifically, 540° C. being assumed hard to cause blister or the like and thought to be as high as possible was selected and retained for 12 hours. In contrast, for aging treatment, 180° C. being assumed to enable making elongation at least 5% at ordinary temperature (i.e. 25° C.) was selected and retained for 8 hours.

Under the conditions of treatment as selected above, solution treatment and aging treatment were applied on the cast impeller thus obtained. Likewise, in view of a composition, conditions of treatment were selected for a cast impeller formed from A354 being a conventional casting alloy, solution treatment was applied at 525° C. for 8 hours, and aging treatment was applied at 163° C. for 8 hours. In addition, a cast impeller formed from A2618 being a conventional forged alloy was subjected to T6 treatment but specific conditions of treatment therefor were unclear.

In the producing process, a cast compressor impeller could be obtained by the use of the casting aluminum alloy of the invention. The impeller 1 thus obtained was shaped to be applicable to, for example, a compressor impeller for diesel engines of automobiles and had a maximum diameter of ϕ80 mm (hub disk part 3), a total height of 55 mm (hub shaft part 2), full blades 6 and splitter blades 7, the total number of which was 12, and a dimension of a wall thickness of blade tip ends being 0.4 to 0.6 mm.

Subsequently, for round bar tension test pieces sampled from a thick-walled portion near to a maximum diameter of the hub disk part 3 of the impeller 1 thus obtained, 0.2% yield strength, elongation, and tensile strength at ordinary temperature (i.e. 25° C.) were measured. Also, 0.2% yield strength, elongation, and tensile strength were measured at 150° C., 200° C., and 250° C. in addition to ordinary temperature. In addition, for a cast impeller formed from a forged alloy A2618, test pieces were cut from a forged impeller as purchased.

TABLE 3 shows results of measurement. The testing method is described in JIS-Z2241 and G0567, and elongation as measured corresponds to fracture elongation defined as permanent elongation of a gauge length after fracture.

TABLE 3

| | Ordinary temperature (25° C.) | | | 150° C. | | | 200° C. | | |
|---|---|---|---|---|---|---|---|---|---|
| No. | Tensile strength MPa | 0.2% yield strength MPa | Elongation % | Tensile strength MPa | 0.2% yield strength MPa | Elongation % | Tensile strength MPa | 0.2% yield strength MPa | Elongation % |
| 1 | 414 | 319 | 8.5 | — | — | — | — | — | — |
| 2 | 411 | 327 | 6.2 | — | — | — | — | — | — |
| 3 | 458 | 364 | 7.2 | — | — | — | — | — | — |
| 4 | 450 | 361 | 7.1 | 387 | 345 | 8.7 | 348 | 318 | 8.3 |
| 5 | 456 | 360 | 7.3 | 393 | 349 | 8.9 | 351 | 320 | 8.5 |
| A354 | 396 | 298 | 7.0 | 321 | 274 | 12.3 | 277 | 252 | 8.8 |
| A2618 | 440 | 359 | 8.0 | 390 | 342 | 13.2 | 337 | 306 | 13.5 |

TABLE 3-continued

| | 250° C. | | | |
|---|---|---|---|---|
| No. | Tensile strength MPa | 0.2% yield strength MPa | Elongation % | Remarks |
| 1 | — | — | — | Embodiment of invention |
| 2 | — | — | — | Embodiment of invention |
| 3 | — | — | — | Embodiment of invention |
| 4 | 280 | 275 | 6.7 | Embodiment of invention |
| 5 | 288 | 278 | 6.9 | Embodiment of invention |
| A354 | 212 | 201 | 12.4 | Conventional example (cast) |
| A2618 | 226 | 213 | 16.1 | Conventional example (forged) |

All cast compressor impellers formed by the use of the casting aluminum alloy of the invention could have 0.2% yield strength of more than 300 MPa, elongation of more than 5.0%, and tensile strength of more than 400 MPa at ordinary temperature (i.e. 25° C.). In particular, the compositions No. 3 to No. 5 attained 0.2% yield strength of 360 MPa and tensile strength of 450 MPa to be markedly superior to a conventional cast alloy A354 and had properties equal to or higher than a conventional forged alloy A2618. Also, at 150° C., 0.2% yield strength of around 340 MPa and tensile strength of around 390 MPa, which were equal to those of a conventional forged alloy A2618, could be obtained. Further, at 200° C., 0.2% yield strength of around 320 MPa and tensile strength of around 350 MPa, which exceeded those of a conventional forged alloy A2618, could be obtained. Furthermore, even in a high temperature range of 250° C., 0.2% yield strength of 270 MPa and tensile strength of 280 MPa were obtained. In a temperature range of ordinary temperature (i.e. 25° C.) to 200° C. and further 250° C., elongation of 5.0% or more could be obtained.

Subsequently, the microstructure of the casting aluminum alloy of the invention after solution treatment and aging treatment was examined. Specifically, test pieces were cut from cast compressor impellers having compositions of No. 3 and No. 5 in TABLE 3 and examined. In addition, with respect to the relationship between Cu content and Ni content, No. 5 fulfills the equation Ni≦1.08Cu-2.0% and No. 3 has a composition that does not fulfill the equation. In addition, both the contents meet Ni≦1.08Cu-2.43%.

It was recognized that a structure of No. 3 included a large quantity of crystallized substance as compared with a structure of No. 5. In SEM analysis (map analysis) of crystallized substances respectively recognized, it was found that main components thereof were Cu and Ni. Further, it was found in quantitative analysis that proportions of Al content, Cu content, and Ni content were substantially 5, 1, and 1 by atomic %. It was found in the respective analyses that the crystallized substance was $Al_5NiCu$ (Y phase). Thereby, it could be inferred that for an improvement in 0.2% yield strength and tensile strength, it was effective to optimize crystallization of Y phase through adjustment of Cu content and Ni content.

Also, the composition (Cu: 4.08%, Ni: 1.99%, Mg: 1.60%, Ti: 0.10%, Si: 0.60%, Fe: 0.13%, B: 0.017%) of No. 4 and the composition (Cu: 4.01%, Ni: 1.71%, Mg: 1.68%, Ti: 0.10%, Si: 0.55%, Fe: 0.10%, B: 0.019%) of C3 shown in TABLE 1 can be said to be substantially the same while there is a difference of 0.28% in Ni content between there.

Accordingly, it was found that formation by application of plaster mold casting rather than casting by the use of the JIS 4 type boat form metal die can expect the casting aluminum alloy of the invention to become further excellent in mechanical properties such as 0.2% yield strength and tensile strength while possessing elongation of at least 5.0% or more.

Embodiment 3

In an example of the casting aluminum alloy of the invention, those conditions for solution treatment and aging treatment, under which preferable mechanical properties were obtained, were selected. The selection was carried out using cast impellers having that composition (Cu: 3.54%, Ni: 2.81%, Mg: 1.38%, Ti: 0.10%, Si: 0.06%, Fe: 0.13%, B: 0.017%), which provided an example of the casting aluminum alloy of the invention indicated by No. 3 in TABLE 2. In addition, evaluation was made with respect to the case where HIP treatment was not applied and the case where HIP treatment was applied at 525° C. at 103 MPa for 2 hours.

Also, it was predicted that in view of the composition of the casting aluminum alloy of the invention, it was preferable to select solution treatment and aging treatment in the range of 480 to 550° C. and 6 to 16 hours. Also, in view of productivity, conditions for solution treatment were selected so as to enable making a retention time as short as possible, and thus conditions of treatment of retention at 540° C., which was assumed to be hard to generate blister or the like and as high as possible, for 12 hours were selected. In this manner, solution treatment was carried out under specific conditions and aging treatment was carried out under different conditions of treatment.

TABLE 4 shows results.

TABLE 4

| | HIP | | | Solution treatment | | Aging treatment | | Ordinary temperature (25° C.) | | |
|---|---|---|---|---|---|---|---|---|---|---|
| No. | temperature ° C. | pressure MPa | Time h | Temperature ° C. | Time h | Temperature ° C. | Time h | Tensile strength MPa | 0.2% yield strength MPa | Elongation % |
| A1 | 525 | 103 | 2 | 540 | 12 | 160 | 3 | 433 | 288 | 15.0 |
| A2 | 525 | 103 | 2 | 540 | 12 | 160 | 5 | 433 | 286 | 15.3 |
| A3 | 525 | 103 | 2 | 540 | 12 | 160 | 8 | 435 | 296 | 12.9 |
| A4 | 525 | 103 | 2 | 540 | 12 | 160 | 15 | 436 | 315 | 10.2 |

TABLE 4-continued

| | HIP | | | Solution treatment | | Aging treatment | | Ordinary temperature (25° C.) | | |
|---|---|---|---|---|---|---|---|---|---|---|
| No. | temperature ° C. | pressure MPa | Time h | Temperature ° C. | Time h | Temperature ° C. | Time h | Tensile strength MPa | 0.2% yield strength MPa | Elongation % |
| A5 | — | — | — | 540 | 12 | 160 | 3 | 430 | 285 | 13.3 |
| A6 | — | — | — | 540 | 12 | 160 | 5 | 436 | 291 | 14.0 |
| A7 | — | — | — | 540 | 12 | 160 | 8 | 436 | 298 | 13.2 |
| A8 | — | — | — | 540 | 12 | 160 | 15 | 444 | 311 | 12.1 |
| A9 | 525 | 103 | 2 | 540 | 12 | 180 | 3 | 444 | 335 | 9.4 |
| A10 | 525 | 103 | 2 | 540 | 12 | 180 | 5 | 451 | 350 | 8.8 |
| A11 | 525 | 103 | 2 | 540 | 12 | 180 | 8 | 458 | 364 | 7.2 |
| A12 | 525 | 103 | 2 | 540 | 12 | 180 | 15 | 461 | 380 | 5.6 |
| A13 | 525 | 103 | 2 | 540 | 12 | 200 | 3 | 464 | 388 | 5.2 |
| A14 | 525 | 103 | 2 | 540 | 12 | 200 | 5 | 466 | 391 | 4.5 |
| A15 | 525 | 103 | 2 | 540 | 12 | 200 | 8 | 464 | 402 | 2.9 |
| A16 | 525 | 103 | 2 | 540 | 12 | 200 | 15 | 471 | 424 | 1.2 |

In the case where solution treatment was carried out at 540° C. for 12 hours and aging treatment was carried out as indicated in TABLE 4, there was recognized a tendency that the higher temperature and the longer time in aging treatment, the lower elongation. Contrary to elongation, there was recognized a tendency that the higher temperature and the longer time in aging treatment, the larger 0.2% yield strength. Tensile strength had a similar tendency to that of 0.2% yield strength while being not so conspicuous as the latter, and exhibited 430 MPa or more under all conditions. It was found from the results that in aging treatment, elongation at ordinary temperature (i.e. 25° C.) could not be made larger than at least 5% when temperature exceeded 200° C. Also, it could be assumed that at lower than 150° C., elongation was sufficient but 0.2% yield strength was decreased. Also, it could be recognized that superiority or inferiority in mechanical properties was not determined by presence of HIP treatment.

Therefore, it was recognized that conditions of treatment capable of making mechanical properties preferable were present in that composition (Cu: 3.54%, Ni: 2.81%, Mg: 1.38%, Ti: 0.10%, Si: 0.06%, Fe: 0.13%, B: 0.017%), which provided an example of the casting aluminum alloy of the invention. Also, it was found in the case of the composition described above that taking productivity and cost into consideration and trying to obtain preferable mechanical properties, it was preferable to carry out solution treatment at 540° C. for 12 hours and to carry out aging treatment at a temperature of 180° C. for 8 hours.

It was recognized in the embodiments described above that the casting aluminum alloy of the invention could have a preferable elongation of, for example, 5.0% or more and obtain an excellent 0.2% yield strength and tensile strength even at ordinary temperature (i.e. 25° C.) and at high temperature of 150 to 200° C., and further 250° C. Also, it was found that 0.2% yield strength and tensile strength, which were superior to those of a conventional forged alloy A2618, were obtained by preferably selecting Cu content and Ni content. Accordingly, it was found that a cast compressor impeller formed by the use of the casting aluminum alloy of the invention was one having an excellent characteristic even when an environment of use was the temperature range of 150 to 200° C. being higher than conventional.

BRIEF DESCRIPTION OF THE DRAWINGS

FIG. 2 is a graph showing 0.2% yield strength, elongation, and tensile strength of an aluminum alloy material in the as cast state when Cu content is changed.

FIG. 3 is a graph showing 0.2% yield strength, elongation, and tensile strength of an aluminum alloy material in the as cast state when Ni content is changed.

DESCRIPTION OF REFERENCE NUMERALS IN THE DRAWINGS

Figure 1A:
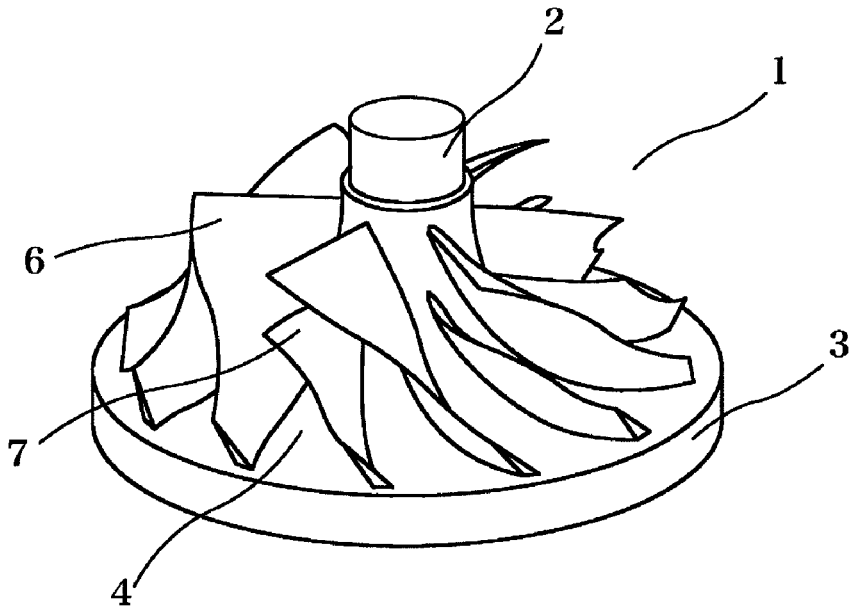
FIG. 1A is a perspective view showing an example of a cast compressor impeller of the invention.
Figure 1B:
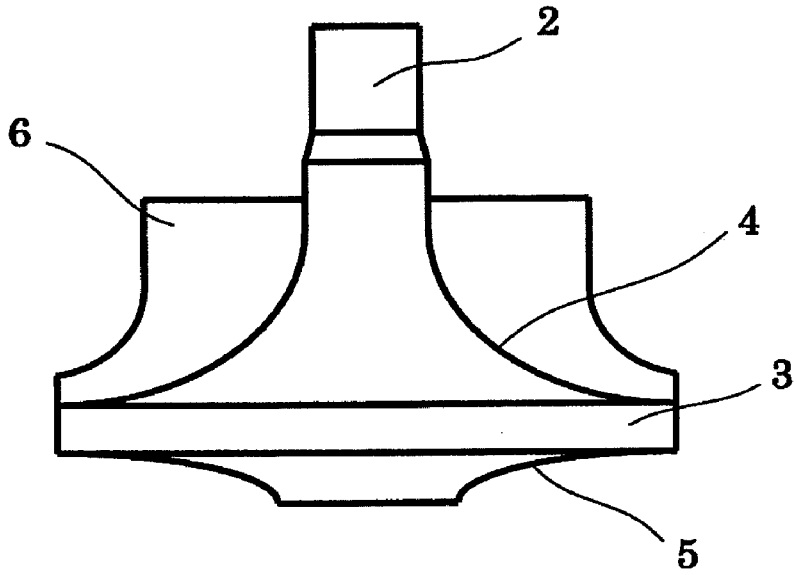
FIG. 1B is a schematic side view showing the cast compressor impeller shown in FIG. 1A.

1: cast compressor impeller
2: hub shaft part
3: hub disk part
4: hub surface
5: disk surface
6: full blade
7: splitter blade

The invention claimed is:

1. A cast compressor impeller formed from a casting aluminum alloy, comprising a hub shaft part, a hub disk part extending radially from the hub shaft part and having a hub surface and a disk surface, and a plurality of blade parts provided on the hub surface, wherein the casting aluminum alloy comprises, by mass %, 3.5 to 5.0% Cu, 0.8 to 3.0% Ni, 1.0 to 3.0% Mg, 0.05 to 0.20% Ti, and not more than 1.0% Si, and the balance being Al and unavoidable impurities, and wherein the impeller has a tensile strength of at least 380 MPa and an elongation of at least 5.0% at ordinary temperature (25° C.), a tensile strength of at least 330 MPa at a temperature of 150° C., and a tensile strength of at least 300 MPa at a temperature of 200° C.

2. The cast compressor impeller according to claim 1, wherein the plurality of blade parts comprise full blades and splitter blades, the both blades being arranged alternately.

3. The casting aluminum alloy according to claim 1, which fulfills the equation Ni≦1.08 Cu-2.0% by mass %.

4. The casting aluminum alloy according to claim 1, which fulfills the equation Ni≦1.08 Cu-2.43% by mass %.

5. The casting aluminum alloy, according to claim 1, by mass %, 1.2 to 2.5% Mg and 0.3 to 1.0% Si.

6. The casting aluminum alloy according to claim 1, further comprising, by mass %, 0.001 to 0.06% B.

7. The casting aluminum alloy according to claim 1, comprising, by mass %, 4.0 to 5.0% Cu and 1.0 to 2.0% Ni.

* * * * *